US005774164A

United States Patent [19]

Yamazaki et al.

[11] Patent Number: 5,774,164

[45] Date of Patent: Jun. 30, 1998

[54] THERMAL TRANSFER IMAGE-RECEIVING SHEET

[75] Inventors: Masayasu Yamazaki; Kenichiro Sudo; Satoru Kawai; Takeshi Nozaki, all of Tokyo-To, Japan

[73] Assignee: Dai Nippon Printing Co., Ltd., Japan

[21] Appl. No.: 547,844

[22] Filed: Oct. 25, 1995

[30] Foreign Application Priority Data

Oct. 27, 1994 [JP] Japan ..... 6-287512
Oct. 28, 1994 [JP] Japan ..... 6-288907

[51] Int. Cl.[6] ..... B41M 5/38

[52] U.S. Cl. ..... 347/221; 503/227

[58] Field of Search ..... 347/221; 8/467, 8/471; 503/227; 428/195, 211, 537.5, 913, 914

[56] References Cited

FOREIGN PATENT DOCUMENTS 0 455 213 A1 11/1991 European Pat. Off. .
0 449 369 A1 8/1992 European Pat. Off. .
0 516 370 A1 12/1992 European Pat. Off. .

*Primary Examiner*—Huan H. Tran
*Attorney, Agent, or Firm*—Parkhurst & Wendel, L.L.P

[57] ABSTRACT

The present invention aims to provide a thermal transfer image-receiving sheet which does not suffer from any cockle problem, during printing, associated with a printer or a dye transfer film used. The thermal transfer image-receiving sheet comprises a substrate sheet and, provided on at least one surface thereof in the following order, an intermediate layer and a receptive layer, the intermediate layer containing either an acrylic polyol or cellulose acetate butyrate.

Further, the present invention provides a thermal transfer image-receiving sheet which has a capability of preventing curling and causes no damage to an image-receiving surface even when image-receiving sheets put on top of each other or one another are used. This thermal transfer image-receiving sheet comprises a back surface layer provided on a substrate sheet in its surface where no image is to be formed, the back surface layer containing an acrylic polyol.

12 Claims, No Drawings

THERMAL TRANSFER IMAGE-RECEIVING SHEET

BACKGROUND OF THE INVENTION

The present invention relates to a thermal transfer recording medium and particularly to a thermal transfer-image receiving sheet used in combination with a thermal transfer sheet.

Various thermal transfer recording systems are known in the art. Among others, a sublimation dye transfer recording system, where a thermal transfer sheet comprising a support, such as a polyester film, bearing thereon a thermal transfer layer containing a sublimable dye is heated by means of a heating medium, such as a thermal head or a laser beam, to form a dye image on a recording medium, is used as information recording means in various fields.

According to this system, a full-color image of an original can be reproduced by heating for a very short period of time. Further, the resultant image has high sharpness and excellent transparency, offering excellent half tone reproduction and gradation. By virtue of this nature, it is possible to form an image having a high quality comparable to that of a full-color photographic image.

However, heating during the formation of an image often causes a dye transfer film used to be expanded and contracted, resulting in occurrence of cockle (wrinkle) in the dye transfer film. Regarding the "cockle," the size, the number, the direction and the like vary depending upon the kind of the image formed. In general, in order to form a high-density image, the printing energy should be increased. Increased printing energy, however, results in increased frequency of cockle. A large difference in image density is also likely to cause cockle.

Further, the occurrence of cockle becomes particularly significant when an OHP sheet is used as an object on which an image is recorded. The reason for this is believed to reside in that, since the sensitivity of the OHP sheet is low, the printing energy should be increased when high-density printing is contemplated.

Since heat energy is not transmitted from the thermal head to the "cockled" portion, dropout occurs in the resultant image, causing the cockle, as such, to be reproduced. This renders the image with a reproduced cockle image area useless.

Although various methods have been attempted to prevent the occurrence of cockle, they could not completely prevent the occurrence of cockle during printing.

Regarding the conventional image-receiving medium, paper or a plastic film, or alternatively an image-receiving sheet with a receptive layer optionally formed on an image-recording surface is used as an image-receiving medium. Further, in order to prevent curling or improve the slip property, a back surface layer using an acrylic resin as a binder and containing an organic filler, such as an acrylic resin or TEFLON, or an inorganic filler, such as silica, as an additive is provided on the image-receiving medium in its surface where no image is to be formed.

The conventional back surface layer using an acrylic resin as the binder, however, is not always unsatisfactory in the effect of preventing curling.

Further, when several image-receiving sheets having the conventional back surface layer are put on top of one another and then fed one by one using a feed roll or the like, the back surface layer and the image-receiving surface are rubbed against each other, causing a problem of damage to the image-receiving surface.

DISCLOSURE OF THE INVENTION

Accordingly, the first object of the present invention is to solve the above problem of the prior art, i.e., a problem of the occurrence of cockle during printing, and to provide a thermal transfer image-receiving sheet which does not suffer from the occurrence of cockle during printing independently of the printer and dye transfer film used.

The second object of the present invention is to provide a thermal transfer image-receiving sheet which has an excellent capability of preventing curling and causes no damage to the image-receiving surface even when a plurality of image-receiving sheets are put on top of another and then used.

In order to attain the first object, the thermal transfer image-receiving sheet of the present invention comprises a substrate sheet and, provided on at least one surface of the substrate sheet in the following order, an intermediate layer and a receptive layer, the intermediate layer containing either an acrylic polyol or cellulose acetate butyrate.

The intermediate layer formed of an acrylic polyol or cellulose acetate butyrate has good adhesion to overlying and underlying layers and can efficiently transmit heat energy from the thermal head, enabling the occurrence of cockle during printing to be effectively prevented.

In order to attain the second object, the thermal transfer image-receiving sheet according to the present invention comprises a substrate sheet and a receptive layer provided on one surface of the substrate sheet, a back surface layer containing an acrylic polyol being provided on the substrate sheet in its surface where no receptive layer is provided.

The use of the acrylic polyol in the back surface layer results in a significant improvement in the capability of preventing curling. Further, the acrylic polyol can easily hold an additive, such as a filler, i.e., has a high holding capability. Furthermore, it has good adhesion to the substrate.

BEST MODE FOR CARRYING OUT THE INVENTION

In the thermal transfer image-receiving sheet according to the first aspect of the present invention, an intermediate layer formed of either an acrylic polyol or cellulose acetate butyrate is provided.

In the thermal transfer image-receiving sheet according to the second aspect of the present invention, a back surface layer containing an acrylic polyol is provided.

Each element constituting the two inventions will now be described.

Substrate Sheet

The substrate sheet serves to hold a receptive layer and, at the same time, since heat is applied at the time of formation of an image, preferably has good mechanical strength enough to be handled in a heated state without any problem.

Materials for the substrate sheet are not particularly limited, and examples thereof include capacitor paper, glassine paper, parchment paper, paper having a high sizing content, synthetic paper (polyolefin paper and polystyrene paper), wood-free paper, art paper, coated paper, cast-coated paper, wallpaper, backing paper, paper impregnated with a synthetic resin or an emulsion, paper impregnated with a synthetic rubber latex, paper with a synthetic resin internally added thereto, paper board, cellulosic fiber paper, and films of polyester, polyacrylate, polycarbonate, polyurethane, polyimide, polyetherimide, cellulose derivative, polyethylene, ethylene/vinyl acetate copolymer, polypropylene, polystyrene, acrylic resin, polyvinyl chloride, polyvinylidene chloride, polyvinyl alcohol, polyvinyl butyral, nylon, polyetherether ketone, polysulfone, polyethersulfone, tetrafluoroethylene-perfluoroalkyl vinyl ether, polyvinyl fluoride, tetrafluoroethylene-ethylene, tetrafluoroethylene-hexafluoropropylene, polychlorotrifluoroethylene, and polyvinylidene fluoride. Further, it is also possible to use a white opaque film formed by adding a white pigment or a filler to the above synthetic resin and forming the mixture into a film, or a foamed sheet prepared by foaming the above synthetic resin, and, as described above, the materials for the substrate sheet are not particularly limited.

Furthermore, it is also possible to use a laminate comprising any combination of the above substrate sheets. Representative examples of such a laminate include a laminate comprising a cellulosic fiber paper and a synthetic paper and a laminate comprising a cellulosic fiber paper, a plastic film, and a synthetic paper.

In the present invention, the substrate sheet preferably has a surface resistivity of not more than $1.0\times10^{12}\Omega/\square$ as measured under environmental conditions of a temperature of 20° C. and a humidity of 50%. The term "surface resistivity" used herein is "a value determined by dividing a potential gradient in a direction parallel to a current flowing along the surface of a specimen by a current per unit width of the surface of the specimen," as defined in JIS K 6911. The surface resistivity is usually expressed in terms of Ω. In the present invention, however, it is expressed in terms of $\Omega/\square$ from the viewpoint of distinguishing the surface resistivity from mere resistance.

A substrate sheet having a surface resistivity of not more than $1.0\times10^{12}\Omega/\square$ as measured under environmental conditions of a temperature of 20° C. and a humidity of 50% is selected from among the above substrate sheets or alternatively prepared by subjecting any one of the above substrate sheets to antistatic treatment. The use of the substrate having the above surface resistivity can impart the antistatic effect and, hence, can prevent occurrence of trouble caused by static electricity at the time of production of an image-receiving sheet. Moreover, it can further enhance the effect of a resin layer, having an antistatic effect, which will be described later. When this substrate is not used, the effect of the conductive intermediate layer is unsatisfactory under a low temperature and low humidity (for example, temperature 10° C. and humidity 10%) environment, often posing a carrying trouble and, further, a trouble occurs due to static electricity in the course of production of an image-receiving sheet.

When the use of the thermal transfer image-receiving sheet as a sheet for OHP is contemplated, a transparent sheet may be selected from the above sheets.

In the use as a sheet for OHP, the haze (as measured according to JIS-K-7105-1981.6.4) of the whole image-receiving sheet having the following individual layers is not more than 15%, preferably not more than 5%.

The thickness of the above substrates is usually in the range of about 3 to 200 μm. When the adhesion between the above substrate and a layer provided thereon is poor, the surface is preferably subjected to primer treatment or corona discharge treatment.

Antistatic Layer

The antistatic layer is an element which is optionally provided in both the first and second inventions.

In the present invention, the antistatic layer refers to a resin layer having an antistatic effect. The resin layer may be formed of a resin having an antistatic effect or alternatively a mixture of a conventional resin having no antistatic effect with a conductive material.

Resins having an antistatic effect include, for example, a conductive resin prepared by introducing a group having an antistatic effect, such as a quaternary ammonium salt, phosphoric acid, etosulfite, vinylpyrrolidone, or sulfonic acid, into a resin, such as an acrylic resin, a vinyl resin, or a cellulose resin, or copolymerizing the above group with the above resin. A cation-modified acrylic resin is preferred.

Preferably, these groups having an antistatic effect are introduced in a pendant form into the resin because they can be introduced in a high density into the resin. Specific examples of such resins include Jurymer series manufactured by Nihon Junyaku Co., Ltd., Reolex series manufactured by Dai-ichi Kogyo Seiyaku Co., Ltd., and Elecond series manufactured by Soken Chemical Engineering Co., Ltd.

The above conductive resin, as such, may be used to form the intermediate layer. Alternatively, it may be used in the form of a mixture thereof with a conventional resin, described below, from the viewpoint of improving the layer strength and the adhesion to the substrate or other layers. When the conductive resin is used in a mixture form, the proportion of the conductive resin to the whole antistatic layer is preferably not less than 50% by weight. When the proportion is less than 50% by weight, there is a possibility that the antistatic effect is lowered, resulting in carrying troubles.

On the other hand, when a conductive material is added to form an antistatic layer, usable conductive materials include fine particles of metal oxides, such as zinc oxide, titanium oxide, and tin oxide. The diameter of the fine particles is generally not more than 50 μm. However, when the image-receiving sheet of the present invention is used as a sheet for OHP, the antistatic layer formed should be transparent. In this case, the fine particles to be incorporated has a particle diameter of not more than 10 μm, preferably not more than 5 μm.

Conventional resins usable in combination with the conductive material include resins, such as a polyester resin, an acrylic resin, a vinyl resin, a cellulosic resin, a halogenated polymer, a polyolefin resin, a polystyrene resin, a polyamide resin, a polycarbonate resin, a polyvinyl acetal resin, or a polyvinyl alcohol resin, or a copolymer of the above monomers. These resins may be used in combination with a conductive resin.

The provision of the above antistatic layer enables the resultant image-receiving sheet to have a stable antistatic property during and even after printing, and the use of a combination of the conductive intermediate layer with a substrate having an antistatic property offers an antistatic property which is always stable and high without being influenced by environmental change. If the conductive intermediate layer is not provided, problems occur such as carrying troubles during printing, adhesion between image-receiving sheets due to static electricity and failure of the sheet to be fed.

Further, the antistatic layer is preferably in a cured state from the viewpoint of improving the heat resistance. The use of an isocyanate as a curing agent unfavorably affects the antistatic effect of the conductive intermediate layer, and, therefore, a self-crosslinkable conductive resin, wherein a crosslinking reaction occurs between conductive resins, is preferably used. The use of a conductive resin having a glass transition point of 40° C. or above is also preferred.

The antistatic layer may be provided on either side of the substrate. When the provision of the antistatic layer on the receptive layer side of the substrate is contemplated, the antistatic layer may be interposed between the substrate and the intermediate layer or between the intermediate layer and the receptive layer. In order to efficiently exhibit the function of the intermediate layer, it is preferred to provide the antistatic layer between the substrate and the intermediate layer.

Intermediate Layer

First Invention:

In the first invention, the incorporation of either an acrylic polyol or cellulose acetate butyrate into the intermediate layer is indispensable.

The intermediate layer has good adhesion to overlying and underlying layers, for example, the receptive layer and the antistatic layer, and, hence, heat energy from the thermal head can be efficiently transmitted to the underlying layer, enabling the occurrence of cockle of the dye transfer film during printing to be prevented.

The acrylic polyol is typically a polymer of ethylene glycol methacrylate: $CH_2{=}C(CH_3)COOH_2CH_2OH$. In addition, it is also possible to use compounds wherein the above ethylene glycol moiety is replaced with propylene glycol, trimethylene glycol, butanediol, pentanediol, hexanediol, cyclopentanediol, cyclohexanediol, glycerin or the like. Among them, compounds using ethylene glycol, propylene glycol, or both of them are particularly preferred. The OH value of the acrylic polyol is preferably from 15 to 55, particularly preferably from 20 to 45. When the OH value is less than 15, the heat resistance and the solvent resistance tend to be poor. Further, in this case, a lot of time is required for completely curing the acrylic polyol. On the other hand, when the OH value is more then 55, problems tend to occur including shortened pot life of the coating solution for an intermediate layer and formation of a fragile intermediate layer film.

The cellulose acetate butyrate preferably has a degree of acetylation of from 0.5 to 15% (as measured by a method specified in ASTM D817). Further, preferably, it has a degree of butylation of from 20 to 60% (as measured by a method specified in ASTM D817). Furthermore, the hydroxyl content is preferably from 0.5 to 5% (as measured by a method specified in ASTM D817). Preferably, the cellulose acetate butyrate has a viscosity of from 0.1 to 10 Poise (as measured by a method specified in ASTM D817) and a melting point of from 100° to 200° C.

Cured resin for constituting the intermediate layer can advantageously serve to further improve the adhesion to the receptive layer or the antistatic layer. Further, the heat resistance of the intermediate layer per se can be improved.

Curing may be carried out using a curing agent such as an isocyanate or a chelate compound. Alternatively, the resin may be cured by heating or electron beam or UV irradiation without use of any curing agent.

When the curing agent is used, it may be any known curing agent. Among others, an isocyanate compound is preferred. As a result of a reaction of the intermediate layer resin with an isocyanate compound or the like, the resin is cured to form a stereostructure, resulting in further improved heat resistance and storage stability and, at the same time, improved solvent resistance.

The amount of the curing agent added is preferably 1 to 2 per reactive group equivalent of resin. When it is less than 1, a lot of time is taken for completely curing the resin. Further, in this case, the heat resistance and the solvent resistance are deteriorated. On the other hand, when it is larger than 2, problems occur including a change of the resultant film with the elapse of time and shortened pot life of the coating solution for an intermediate layer.

The acrylic polyol or cellulose acetate butyrate may also be used in combination with a resin. For example, the addition of a resin having a higher glass transition point can improve the storage stability of the image-receiving sheet.

Second Invention:

In the second invention, the provision of the intermediate layer is not essential, and an intermediate layer composed mainly of various resins may be optionally provided between the substrate sheet and the receptive layer or between the receptive layer and the antistatic layer. In this case, the material for forming the intermediate layer can be properly selected according to properties to be imparted, such as cushioning properties and storage stability.

For example, the formation of a resin layer having a glass transition temperature of 60° C. or above or a resin layer cured with a curing agent, as a heat-resistant intermediate layer, results in improved storage stability of the thermal transfer image-receiving sheet, and the adhesion between thermal transfer image-receiving sheets can be prevented during storage in such a state that a number of thermal transfer image-receiving sheets are put on top of one another, and, at the same time, the cushioning properties of the thermal transfer image-receiving sheet can be improved, preventing variation of density due to variation of printing by means of a thermal head and the occurrence of cockle.

Regarding the impartation of the cushioning properties, the use of a resin having large elastic deformation or plastic deformation, for example, a vinyl chloride/vinyl acetate copolymer resin, a urethane resin, or a polyamide resin, can contribute to an improvement in print density and sensitivity of the image-receiving sheet.

Further, the use of either the acrylic polyol or cellulose acetate butyrate can advantageously result in improved adhesion to the receptive layer or the antistatic layer, promoting the diffusion of heat from the thermal head during printing. This prevents cockling of the dye transfer film during printing.

When the intermediate layer is formed of a cured resin, it has better adhesion to the receptive layer and the antistatic layer and, at the same time, as such has improved heat resistance.

Curing may be carried out using a curing agent, such as an isocyanate or chelate compound, or alternatively by curing between resins by heat or by irradiation with ultraviolet light, electron beam or the like.

Image-receiving Layer

A receptive layer serves to receive a dye which, upon heating, is transferred from a thermal transfer sheet and, at the same time, to hold thereon a formed image. Resins for forming the receptive layer include, for example, polyolefin resins, such as polypropylene; halogenated polymers, such as polyvinyl chloride and polyvinylidene chloride; vinyl resins, such as polyvinyl acetate and polyacrylic esters; polyester resins, such as polyethylene terephthalate and polybutylene terephthalate; polystyrene resins; polyamide resins; ionomers; cellulosic resins, such as cellulose acetate; polycarbonate resins; polyvinyl acetal resins; polyvinyl alcohol resins; and resins of copolymers of the above resins or monomers thereof, for example, vinyl chloride/vinyl acetate copolymer and ethylene/vinyl acetate copolymer.

The above receptive layer may have either a single layer structure or a multi-layer structure.

The use of a cured resin layer as the receptive layer is preferred because surface roughening at the time of printing can be prevented. The cured resin layer may be formed of a product of a reaction of at least one resin, which is prepared by modifying the above resin with a group reactive with a curing agent, for example, a reactive group, such as a hydroxyl, carboxyl, or amino group, or alternatively by adding the above reactive group to the above resin, with a curing agent, such as a polyisocyanate compound, a polymethylol compound, an epoxy compound, or a chelate compound. Further, it is also possible to use a product of a reaction of curing agents with each other. The cured receptive layer is advantageous also in that, even when additives, such as ultraviolet absorbers and antistatic agents, are added thereto, the cured receptive layer is less likely to be influenced by the additives because part of the receptive layer is in a cured state.

Further, after the formation of the receptive layer containing a curing agent, a receptive layer not containing any curing agent may be provided thereon. Any combination of receptive layer resins may be possible. In this case, the coverage of the outermost layer should be not more than 1.5 $g/m^2$, particularly preferably not more than 1.0 $g/m^2$. When the coverage exceeds 1.5 $g/m^2$, roughening of the surface of the receptive layer in its high-density printing area cannot be prevented.

It is also possible to add a fatty acid to the receptive layer. The fatty acid can be incorporated into two groups, i.e., saturated fatty acids and unsaturated fatty acids, and the saturated fatty acids can be divided further into those having a straight-chain structure and those having a side chain, such as an alkyl group. The incorporation of the fatty acid into the receptive layer can improve the sensitivity and image density in the formation of an image.

Particularly preferred are straight-chain saturated fatty acids, having a melting point of 50° to 100° C., with 14 or more carbon atoms. Specific compounds and their melting points are: myristic acid (58° C.), pentadecylic acid (53° to 54° C.), palmitic acid (63° to 64° C.), heptadecylic acid (60° to 61° C.), stearic acid (71.5° to 72° C.), nonadecanoic acid (68.7° C.), cerotic acid (77° C.), behenic acid (81° to 82° C.), lignoceric acid (83.5° C.), cerotic acid (87.9° C.), heptaconic acid (82° C.), montanic acid (89.3° C.), melissic acid (93° to 94° C.), and lacceric acid (95° to 96° C.).

A receptive layer using a fatty acid having a melting point of 50° C. or below is likely to be heat-fused to the dye layer of the thermal transfer sheet during printing, often posing a matting problem of the surface of the receptive layer. It further deteriorates the storage stability of the image. A fatty acid having a melting point of 100° C. or above has lowered solubility, resulting in opaque receptive layer. Consequently, the resultant thermal transfer image-receiving sheet is unsuitable particularly as a sheet for OHP.

The fatty acid used is at least one member selected from the above and/or other fatty acids. The content thereof is preferably from 0.1 to 20% by weight, still preferably from 0.5 to 15% by weight. When it is less than 0.1% by weight, the contemplated effect cannot be attained by the addition of the fatty acid. On the other hand, when the fatty acid is added in an amount exceeding 20% by weight, the fatty acid is bled out on the surface of the receptive layer or causes layer separation, rendering the receptive layer opaque. Further, in this case, the receptive layer is likely to be heat-fused to the dye layer.

Further, pigments and fillers, such as titanium oxide, zinc oxide, kaolin clay, calcium carbonate, and finely divided silica, may also be added from the viewpoint of further enhancing the sharpness of the transferred image through an improvement in whiteness of the receptive layer. In the case of a sheet for OHP, however, the amount of the pigment or additive should be such that the transparency necessary for OHP is not lost.

The receptive layer is formed by coating, on the intermediate layer, either a solution of a mixture of the resin with necessary additives in a suitable organic solvent or a dispersion of the above mixture in an organic solvent or water by coating means, for example, gravure printing, screen printing, reverse-roll coating using a gravure plate and drying the resultant coating.

The receptive layer thus formed may have any thickness, generally a thickness in the range of from 1 to 50 $\mu$m.

Other Layer

An layer composed mainly of various resins may optionally be provided between the substrate sheet and the receptive layer or between the receptive layer and the antistatic layer. In this case, the material for forming the optional layer can properly be selected according to properties to be imparted, such as cushioning properties and storage stability.

For example, the formation of a resin layer having a glass transition temperature of 60° C. or above or a resin layer cured with a curing agent, as a heat-resistant layer, results in improved storage stability of the thermal transfer image-receiving sheet, and the adhesion between thermal transfer image-receiving sheets can be prevented during storage in such a state that a number of thermal transfer image-receiving sheets are put on top of one another, and, at the same time, the cushioning properties of the thermal transfer image-receiving sheet can be improved, preventing variation of density due to variation of printing by means of a thermal head and the occurrence of cockle.

Regarding the impartation of the cushioning properties, the use of a resin having large elastic deformation or plastic deformation, for example, a vinyl chloride/vinyl acetate copolymer resin, a urethane resin, or a polyamide resin, can contribute to an improvement in print density and sensitivity of the image-receiving sheet.

Further, the use of either the acrylic polyol or cellulose acetate butyrate can advantageously result in improved adhesion to the receptive layer or the antistatic layer, promoting the diffusion of heat from the thermal head during printing. This prevents cockling of the dye transfer film during printing.

When the intermediate layer is formed of a cured resin, it has better adhesion to the receptive layer and the antistatic layer and, at the same time, as such has improved heat resistance.

Curing may be carried out using a curing agent, such as an isocyanate or chelate compound, or alternatively by curing between resins by heat or by irradiation with ultraviolet light, electron beam or the like.

Back Surface Layer

In the first invention, the provision of a back surface layer is not essential, and a back surface layer may be, if necessary, provided on the back surface of the thermal transfer image-receiving sheet from the viewpoints of improving the capability of the sheet to be mechanically carried and, at the same time, preventing the occurrence of curling.

The back surface layer may be formed of a mixture of a resin, such as acrylic resin, cellulosic resin, polycarbonate resin, polyvinyl acetal resin, polyvinyl alcohol resin, polyamide resin, polystyrene resin, polyester resin, or halogenated polymer, with an additive, for example, an organic filler, such as acrylic filler, nylon filler, TEFLON filler, or polyethylene wax or an inorganic filler, such as silicon dioxide or metal oxide. Among them, an acrylic resin is preferred with an acrylic polyol being most preferred. Further, a cured resin prepared by curing an acrylic polyol with a curing agent is preferred. This acrylic polyol will be described below.

Second Invention:

In the thermal transfer image-receiving sheet according to the second invention, a back surface layer containing an acrylic polymer is provided.

The acrylic polyol is typically a polymer of ethylene glycol methacrylate: $CH_2{=}C(CH_3)COOH_2CH_2OH$.

In addition, it is also possible to use compounds wherein the above ethylene glycol moiety is replaced with propylene glycol, trimethylene glycol, butanediol, pentanediol, hexanediol, cyclopentanediol, cyclohexanediol, glycerin or the like. Among them, compounds using ethylene glycol, propylene glycol, or both of them are particularly preferred. The OH value of the acrylic polyol is preferably 15 to 55, particularly preferably 20 to 45. When the OH value is less than 15, the heat resistance and the solvent resistance are poor. Further, in this case, a lot of time is required for completely curing the acrylic polyol. On the other hand, when the OH value is more than 55, problems occur including shortened pot life of the coating solution for a back surface layer and formation of a fragile back surface layer film. The back surface layer formed of an acrylic polyol contributes particularly to prevention of curling. Further, advantageously, the acrylic polyol can easily hold an additive, such as a filler, and has good adhesion to the substrate.

5 to 50 parts by weight, based on 100 parts by weight of the acrylic polyol, of the above resin may be incorporated as the resin other than the acrylic polyol into the acrylic polyol.

The back surface layer is still preferably formed of a resin cured with a curing agent. The curing agent may be any conventional one, and, among others, an isocyanate compound is preferred. As a result of a reaction of the back surface layer resin with an isocyanate compound or the like, the resin is cured to form a stereostructure, resulting in improved heat resistance and storage stability and, at the same time, improved solvent resistance.

The amount of the curing agent added is preferably 1 to 2 per reactive group equivalent of resin. When it is less than 1, a lot of time is taken for completely curing the resin. Further, in this case, the heat resistance and the solvent resistance are deteriorated. On the other hand, when it is larger than 2, problems occur including a change of the resultant film with the elapse of time and shortened pot life of the coating solution for a back surface layer.

An organic filler or an inorganic filler may be added as an additive to the back surface layer. It can improve the carriability of the sheet within a printer and, at the same time, prevent blocking.

Organic fillers include acrylic, nylon, and TEFLON fillers and polyethylene wax, and inorganic filers include silicon dioxide and metal oxides.

The nylon filler is preferably one having a molecular weight of 100,000 to 900,000, a spherical shape, and an average particle diameter of 0.01 to 30 $\mu$m, still preferably one having a molecular weight of 100,000 to 500,000 and an average particle diameter of 0.01 to 10 $\mu$m. As compared with nylon 6 and nylon 66, nylon 12 filler is preferred because it has better water resistance and is free from a change of properties derived from water absorption.

The nylon filler has a high melting point and possesses good heat stability and oil and chemical resistance and, hence, is less likely to be dyed with a dye. Further, it has a self-lubricating property and a low coefficient of friction, and, when the molecular weight is 100,000 to 900,000, the nylon filler is hardly abraded and does not damage counter materials.

A preferred average particle diameter is 0.1 to 30 $\mu$m in the case of a thermal transfer image-receiving sheet for a reflection image and 0.01 to 1 $\mu$m in the case of a thermal transfer image-receiving sheet for a transparent image. When the particle diameter is excessively small, the filler is embedded in the back surface layer, making it difficult for the filler to develop a satisfactory slip property. On the other hand, when it is excessively large, the filler is greatly protruded from the back surface layer, unfavorably resulting in enhanced coefficient of friction and the drop of the filler out of the back surface layer.

The proportion of the filler added is preferably in the range of from 0.01 to 200% by weight based on the resin constituting the back surface layer. In the case of a thermal transfer image-receiving sheet for a reflection image, it is still preferably 1 to 100% by weight, while in the case of a thermal transfer image-receiving sheet for a transparent image (a sheet for OHP), it is still preferably 0.05 to 2% by weight.

When the proportion of the filler is less than 0.01% by weight, the slip property is unsatisfactory, which is causative of troubles such as paper jam. On the other hand, when it exceeds 200% by weight, the sheet is excessively slippery, which is causative of problems such as misregistration of colors in a printed image face.

An antistatic layer may be provided between the back surface layer and the substrate sheet as in the case of the provision of the antistatic layer on the image-receiving layer side. This layer can impart a stable antistatic property also on the back surface side.

Surface Layer

Further, according to the present invention, at least one of the outermost surfaces of the image-receiving sheet may be subjected to antistatic treatment. A first method for carrying out the antistatic treatment is to coat any outermost surface of the image-receiving sheet with a dispersion of fine particles of a metal oxide, such as zinc oxide, titanium oxide, or tin oxide, in a resin, for example, a polyolefin resin, such as polypropylene, a halogenated polymer, such as polyvinyl chloride or polyvinylidene chloride, a vinyl resin, such as polyvinyl acetate or a polyacrylic ester, a polyester resin, such as polyethylene terephthalate or polybutylene terephthalate, a polystyrene resin, a polyamide resin, an ionomer, a cellulosic resin, such as cellulose acetate, a polycarbonate resin, a polyvinyl acetal resin, a polyvinyl alcohol resin, or a copolymer of the above resin or a monomer thereof, such as vinyl chloride/vinyl acetate copolymer or ethylene/vinyl acetate copolymer.

The fine particles of the metal oxide should be present in a mutually bonded state in the surface layer. For this purpose, the fine particles of the metal oxide should be incorporated in an amount of not less than 70% by weight into the surface layer.

A second method for carrying out the antistatic treatment is to coat any outermost surface of the image-receiving sheet with a solution or dispersion of a fatty acid ester, a sulfuric ester, a phosphoric ester, an amide, a quaternary ammonium salt, a betaine, an amino acid, an acrylic resin, or an ethylene oxide adduct in a solvent.

It is also possible to coat the above conductive resin.

In any of the above methods, the coverage is preferably 0.001 to 0.1 g/m$^2$.

Furthermore, various methods other than coating, specifically spraying, transfer and the like, may also be used.

By virtue of the provision of the surface layer, the resultant image-receiving sheet has an excellent antistatic property before printing, enabling carrying troubles, such as simultaneous feeding of a plurality of sheets, to be prevented. When the surface layer is absent, the antistatic property of the image-receiving sheet before printing is unsatisfactory, and, consequently, the carrying troubles, such as simultaneous feeding of a plurality of sheets, often occur.

Thermal transfer sheets for thermal transfer using the above thermal transfer image-receiving sheet include a dye sublimation type thermal transfer sheet used in a dye sublimation transfer recording system and, in addition, a hot melt type thermal transfer sheet, comprising a substrate bearing, coated thereon, a hot melt ink layer of a pigment or the like held by a hot melt binder, wherein upon heating the ink layer too is transferred to a material on which an image is to be transferred.

In the thermal transfer, thermal energy may be applied by any conventional means. For example, a contemplated purpose can be sufficiently attained by applying a thermal energy of about 5 to 100 mJ/mm$^2$ through the control of a recording time by means of a recording device, such as a thermal printer (for example, a video printer VY-100 manufactured by Hitachi, Limited).

EXAMPLES

The present invention will now be described in more detail with reference to the following examples and comparative examples.

Example A

Preparation of thermal transfer image-receiving sheet: The following materials were provided.

<Substrate Sheet>

Substrate sheet A: A 125 $\mu$m-thick polyester film both surfaces of which have been subjected to antistatic treatment (Lumirror U-94, manufactured by Toray Industries, Inc: surface resistivity on the receptive layer side: $10^{10}\Omega/\square$, surface resistivity on the back surface side: $10^{10}\Omega/\square$).

Substrate sheet B: A 100 $\mu$m-thick polyester film both surfaces of which have been I subjected to antistatic treatment (Lumirror E-22, manufactured by Toray Industries, Inc: surface resistivity on the receptive layer side: $10^{10}\Omega/\square$, surface resistivity on the back surface side: $10^{10}\Omega/\square$).

<Antistatic Layer>

| Antistatic layer A: | |
|---|---|
| Antistatic resin (Elecond PQ-50B, manufactured by Soken Chemical Engineering Co., Ltd.) | 10 parts by weight |
| Toluene | 15 parts by weight |
| Methyl ethyl ketone | 15 parts by weight |

<Intermediate Layer>

| Intermediate layer A | |
|---|---|
| Acrylic polyol resin (Acrydic 47–538, manufactured by Dainippon Ink and Chemicals, Inc.) | 30 parts by weight |
| Butyl acetate | 10 parts by weight |
| Methyl ethyl ketone | 30 parts by weight |
| Toluene | 30 parts by weight |
| **Intermediate layer B:** | |
| Acrylic polyol resin (Acrydic 47–538, manufactured by Dainippon Ink and Chemicals, Inc.) | 30 parts by weight |
| Isocyanate curing agent (Takenate A-14, Manufactured by Takeda Chemical Industries, Ltd.) | 3 parts by weight |
| Catalyst (S-CAT24, manufactured by Sankyo Organic Chemicals Co., Ltd.) | 0.15 part by weight |
| Butyl acetate | 10 parts by weight |
| Methyl ethyl ketone | 30 parts by weight |
| Toluene | 30 parts by weight |
| **Intermediate layer C:** | |
| Acrylic polyol resin (Acrydic A-801P, manufactured by Dainippon Ink and Chemicals, Inc.) | 30 parts by weight |
| Isocyanate curing agent (Takenate A-14, manufactured by Takeda Chemical Industries, Ltd.) | 3 parts by weight |
| Catalyst (S-CAT24, manufactured by Sankyo Organic Chemicals Co., Ltd.) | 0.15 part by weight |
| Butyl acetate | 10 parts by weight |
| Methyl ethyl ketone | 30 parts by weight |
| Toluene | 30 parts by weight |
| **Intermediate layer D:** | |
| Acrylic polyol resin (Acrydic A-815-45, manufactured by Dainippon Ink and Chemicals, Inc.) | 30 parts by weight |
| Catalyst (S-CAT24, manufactured by Sankyo Organic Chemicals Co., Ltd.) | 0.15 part by weight |
| Butyl acetate | 10 parts by weight |
| Methyl ethyl ketone | 30 parts by weight |
| Toluene | 30 parts by weight |
| **Intermediate layer E:** | |
| Cellulose acetate butyrate resin (CAB-04, manufactured by Showa Ink Ind. Co., ltd.) | 30 parts by weight |
| Methyl ethyl ketone | 30 parts by weight |
| Toluene | 30 parts by weight |
| **Intermediate layer V (Comparative Example):** | |
| Urethane resin (CSN-C, manufactured by Showa Ink Ind. Co., ltd.) | 30 parts by weight |
| Methyl ethyl ketone | 35 parts by weight |
| Toluene | 35 parts by weight |
| **Intermediate layer W (Comparative Example):** | |
| Vinyl chloride/vinyl acetate copolymer (#1000GK, manufactured by Denki Kagaku k. k.) | 30 parts by weight |
| Methyl ethyl ketone | 35 parts by weight |
| Toluene | 35 parts by weight |
| **Intermediate layer X (Comparative Example):** | |
| Acrylic resin (Dianal BR-85, manufactured by Mitsubishi Rayon Co., Ltd.) | 10 parts by weight |
| Methyl ethyl ketone | 40 parts by weight |
| Toluene | 40 parts by weight |

<Receptive Layer>

| | |
|---|---|
| Receptive layer A: | |
| Vinyl chloride/vinyl acetate copolymer (Denkalac #1000A, manufactured by Denki Kagaku Kogyo K. K.) | 100 parts by weight |
| Fine particles of silica (Sylysia 310, manufactured by Fuji Sylysia Chemical Ltd.) | 1 part by weight |
| Stearic acid (1st grade, manufactured by Kanto Chemical Co., Inc.) | 5 parts by weight |
| Chelate curing agent (Orgatix TC-100, manufactured by Matsumoto Trading Co., Ltd.) | 5 parts by weight |
| Amino-modified silicone (KF-393, manufactured by the Shin-Etsu Chemical Co., Ltd.) | 3 parts by weight |
| Epoxy-modified silicone (X-22-343, manufactured by the Shin-Etsu Chemical Co., Ltd.) | 3 parts by weight |
| Methyl ethyl ketone | 300 parts by weight |
| Toluene | 300 parts by weight |
| Isopropanol | 50 parts by weight |
| Receptive layer B: | |
| Vinyl chloride/vinyl acetate copolymer (VAGH, manufactured by Union Carbide Corporation) | 50 parts by weight |
| Polyester resin (Vylon 200, manufactured by Toyobo Co., Ltd.) | 50 parts by weight |
| Fine particles of nylon (Orgasol 2002, manufactured by Nihon Rilsan k. k.) | 1 part by weight |
| Stearic acid (1st grade, manufactured by Kanto Chemical Co., Inc.) | 5 parts by weight |
| Chelate curing agent (Orgatix TC-100, manufactured by Matsumoto Trading Co., Ltd.) | 5 parts by weight |
| Amino-modified silicone (KF-393, manufactured by the Shin-Etsu Chemical Co., Ltd.) | 3 parts byweight |
| Epoxy-modified silicone (X-22-343, manufactured by the Shin-Etsu Chemical Co., Ltd.) | 3 parts by weight |
| Methyl ethyl ketone | 300 parts by weight |
| Toluene | 300 parts by weight |
| Isopropanol | 50 parts by weight |

<Slip Layer>

| | |
|---|---|
| Slip layer A: | |
| Acrylic polyol resin (Acrydic 47–538, manufactured by Dainippon Ink and Chemicals, Inc.) | 20 parts by weight |
| Isocyanate curing agent (Takenate A-14, manufactured by Takeda Chemical Industries, Ltd.) | 2 parts by weight |
| Catalyst (S-CAT24, manufactured by Sankyo Organic Chemicals Co., Ltd.) | 0.1 part by weight |
| Fine particles of nylon (Orgasol 2002, manufactured by Nihon Rilsan k. k.) | 0.1 part by weight |
| Methyl ethyl ketone | 40 parts by weight |
| Toluene | 40 parts by weight |
| Slip layer B: | |
| Acrylic resin (Dianal BR-85, manufactured by Mitsubishi Rayon Co., Ltd.) | 100 parts by weight |
| Fine particles of teflon (Ruburon L05, manufactured by Fuji-Division Chemical Ltd.) | 1 part by weight |
| Methyl ethyl ketone | 400 parts by weight |

-continued

| | |
|---|---|
| Toluene | 400 parts by weight |

<Antistatic Treatment>

| Coating solution A for antistatic treatment: | |
|---|---|
| Antistatic agent (TB-34, manufactured by Matsumoto Yushi Seiyaku Co., Ltd.) | 1 part by weight |
| Isopropanol | 2000 parts by weight |

Thermal transfer image-receiving sheets were prepared using the above materials. At the outset, an antistatic layer was formed on the substrate sheet by roll coating, and an intermediate layer was then formed thereon by roll coating. The coverages of the antistatic layer and the intermediate layer were respectively 1.0 g/m$^2$ (dry basis) and 4.0 g/m$^2$ (dry basis). Thereafter, a receptive layer was formed on the intermediate layer by roll coating at a coverage on a dry basis of 4.0 g/m$^2$.

A slip layer was formed on the back surface of the substrate sheet by roll coating at a coverage on a dry basis of 4.0 g/m$^2$. Further, a coating solution for antistatic treatment was coated on either the surface of the receptive layer or the surface of the slip layer or both the surface of the receptive layer and the surface of the slip layer by roll coating at a coverage on a dry basis of 0.01 g/m$^2$.

The coating solutions used are given in Table 1.

The thermal transfer image-receiving sheet of the present invention or the comparative thermal transfer image-receiving sheet and a commercial thermal transfer sheet were put on top of the other so as for the receptive layer to face the dye layer, and heating was carried out through the back surface of the thermal transfer sheet by means of a thermal head.

Recording was carried out under heating conditions of an applied voltage of 12 V and a pulse width of 16 msec. Under these conditions, three colors of yellow, magenta, and cyan were put on top of one another to conduct solid printing. The results are given in Table 2. Properties given in Table 2 were evaluated by the following methods.

(1) Cockle (wrinkle) during printing

The presence of cockle was judged by visually inspecting the printed image.

○: No cockle occurred.

x: Cockle occurred.

(2) Adhesion of intermediate layer

After coating of the receptive layer, an adhesion test was carried out using Cello-Tape.

○: No coated layer delaminated.

x: Any one of the layers delaminated.

TABLE 1

| | Anti-static treat-ment | Recep-tive Layer | Inter-medi-ate layer | Anti-static layer | Sub-strate sheet | Slip layer | Anti-static treat-ment |
|---|---|---|---|---|---|---|---|
| Ex. A1 | A | A | A | A | A | A | A |
| Ex. A2 | A | B | A | A | A | A | A |
| Ex. A3 | A | A | B | A | A | A | A |
| Ex. A4 | A | A | C | A | A | A | A |
| Ex. A5 | None | A | D | A | A | A | None |
| Ex. A6 | A | A | E | A | A | B | None |

TABLE 1-continued

| | Anti-static treat-ment | Recep-tive Layer | Inter-medi-ate layer | Anti-static layer | Sub-strate sheet | Slip layer | Anti-static treat-ment |
|---|---|---|---|---|---|---|---|
| Ex. A7 | A | B | F | A | A | B | None |
| Ex. A8 | A | A | A | A | B | A | None |
| Ex. A9 | None | A | B | A | B | A | A |
| Comp. Ex. A1 | A | A | V | A | A | A | A |
| Comp. Ex. A2 | None | A | W | A | A | A | None |
| Comp. Ex. A3 | A | A | X | A | A | A | A |
| Comp. Ex. A4 | A | A | V | A | B | A | A |

TABLE 2

| | Cockle during printing | Adhesion of intermediate layer |
|---|---|---|
| Ex. A1 | ○ | ○ |
| Ex. A2 | ○ | ○ |
| Ex. A3 | ○ | ○ |
| Ex. A4 | ○ | ○ |
| Ex. A5 | ○ | ○ |
| Ex. A6 | ○ | ○ |
| Ex. A7 | ○ | ○ |
| Ex. A8 | ○ | ○ |
| Ex. A9 | ○ | ○ |
| Comp. Ex. A1 | X | ○ |
| Comp. Ex. A2 | X | ○ |
| Comp. Ex. A3 | ○ | X |
| Comp. Ex. A4 | X | ○ |

As is apparent from the results of the examples and comparative examples, the present invention can prevent the occurrence of cockle in a dye transfer sheet during printing, enabling a very good printed image to be provided.

Further, a thermal transfer image-receiving sheet, which has a slip layer on the back surface thereof and both outermost surfaces of which have been subjected to antistatic treatment, has particularly excellent carriability.

Example B

Preparation of thermal transfer image-receiving sheet: The following materials were provided.

<Substrate Sheet>

Substrate sheet A: A 125 μm-thick polyester film both surfaces of which have been subjected to antistatic treatment (Lumirror U-94, manufactured by Toray Industries, Inc: surface resistivity on the receptive layer side: $10^{10}\Omega/\square$, surface resistivity on the back surface side: $10^{10}\Omega/\square$).

Substrate sheet B: A 100 μm-thick polyester film both surfaces of which have been subjected to antistatic treatment (Lumirror E-22, manufactured by Toray Industries, Inc: surface resistivity on the receptive layer side: $10^{10}\Omega/\square$, surface resistivity on the back surface side: $10^{10}\Omega/\square$).

<Antistatic Layer>

| Antistatic layer: | |
|---|---|
| Antistatic resin (Cation-modified acrylic resin, Elecond PQ-50B, manufactured by Soken Chemical Engineering Co., Ltd.) | 10 parts by weight |
| Toluene | 15 parts by weight |
| Methyl ethyl ketone | 15 parts by weight |

-continued

<Intermediate Layer>

| Intermediate layer A: | |
|---|---|
| Acrylic polyol resin (Acrydic 47-538, manufactured by Dainippon Ink and Chemicals, Inc.) | 30 parts by weight |
| Isocyanate curing agent (Takenate A-14, Manufactured by Takeda Chemical Industries, Ltd.) | 3 parts by weight |
| Catalyst (S-CAT24, manufactured by Sankyo organic Chemicals Co.,Ltd.) | 0.15 part by weight |
| Methyl ethyl ketone | 30 parts by weight |
| Toluene | 30 parts by weight |
| Butyl acetate | 10 parts by weight |

<Receptive Layer>

| Receptive layer A: | |
|---|---|
| Vinyl chloride/vinyl acetate copolymer (VAGH, manufactured by Union Carbide Corporation) | 50 parts by weight |
| Polyester resin (Vylon 200, manufactured by Toyobo Co., Ltd.) | 50 parts by weight |
| Nylon 12 filler (Orgasol 2002, manufactured by Nihon Rilsan k.k.) | 1 part by weight |
| Stearic acid (1st grade, manufactured by Kanto Chemical Co., Inc.) | 5 parts by weight |
| Chelate curing agent (Orgatix TC-100, manufactured by Matsumoto Trading Co., Ltd.) | 5 parts by weight |
| Amino-modified silicone (KF-393, manufactured by the Shin-Etsu Chemical Co., Ltd.) | 3 parts by weight |
| Epoxy-modified silicone (x-22-343, manufactured by the Shin-Etsu Chemical Co., Ltd.) | 3 parts by weight |
| Methyl ethyl ketone | 300 parts by weight |
| Toluene | 300 parts by weight |
| Isopropanol | 50 parts by weight |

<Back Surface Layer>

| Back surface layer A: | |
|---|---|
| Acrylic polyol resin (Acrydic A-801P, manufactured by Dainippon Ink and Chemicals, Inc.) | 20 parts by weight |
| Fine particles of nylon (Orgasol 2002, manufactured by Nihon Rilsan k.k.) | 0.5 part by weight |
| Butyl acetate | 400 parts by weight |
| Toluene | 400 parts by weight |
| **Back surface layer B:** | |
| Acrylic polyol resin (Acrydic 47-538, manufactured by Dainippon Ink and Chemicals, Inc.) | 30 parts by weight |
| Nylon 12 filler (MW-330, manufactured by Shinto Paint Co., Ltd.) | 0.08 part by weight |
| Methyl ethyl ketone | 30 parts by weight |
| Toluene | 30 parts by weight |

-continued

| | |
|---|---|
| Butyl acetate | 10 parts by weight |
| Back surface layer C: | |
| Acrylic polyol resin (Acrydic 47-538, manufactured by Dainippon Ink and Chemicals, Inc.) | 30 parts by weight |
| Isocyanate curing agent (Takenate A-14, Manufactured by Takeda Chemical Industries, Ltd.) | 3 parts by weight |
| Fine particles of nylon (MW-330, manufactured by Shinto Paint Co., Ltd.) | 0.08 part by weight |
| Catalyst (S-CAT24, manufactured by Sankyo Organic Chemicals Co., Ltd.) | 0.15 part by weight |
| Methyl ethyl ketone | 30 parts by weight |
| Toluene | 30 parts by weight |
| Butyl acetate | 10 parts by weight |
| Back surface layer D: | |
| Acrylic polyol resin (Acrydic A-815-45, manufactured by Dainippon Ink and Chemicals, Inc.) | 30 parts by weight |
| Isocyanate curing agent (Takenate A-14, Manufactured by Takeda Chemical Industries, Ltd.) | 3 parts by weight |
| Fine particles of nylon (MW-330, manufactured by Shinto Paint Co., Ltd.) | 0.08 part by weight |
| Catalyst (S-CAT24, manufactured by Sankyo Organic Chemicals Co.,Ltd.) | 0.15 part by weight |
| Methyl ethyl ketone | 30 parts by weight |
| Toluene | 30 parts by weight |
| Butyl acetate | 10 parts by weight |
| Back surface layer E: | |
| Acrylic polyol resin (Acrydic 47-538, manufactured by Dainippon Ink and Chemicals, Inc.) | 30 parts by weight |
| Isocyanate curing agent (Takenate A-14, Manufactured by Takeda Chemical Industries, Ltd.) | 3 parts by weight |
| Fine particles of silica (Sylysia 310, manufactured by Fuji Sylsia Chemical Ltd.) | 0.05 part by weight |
| Catalyst (S-CAT24, manufactured by Sankyo Organic Chemicals Co., Ltd.) | 0.15 part by weight |
| Methyl ethyl ketone | 30 parts by weight |
| Toluene | 30 parts by weight |
| Butyl acetate | 10 parts by weight |
| Back surface layer F: | |
| Acrylic polyol resin (Acrydic 47-538, manufactured by Dainippon Ink and Chemicals, Inc.) | 30 parts by weight |
| Fine particles of silica (Sylysia 310, manufactured by Fuji Sylsia Chemical Ltd.) | 0.05 part by weight |
| Methyl ethyl ketone | 30 parts by weight |
| Toluene | 30 parts by weight |
| Butyl acetate | 10 parts by weight |
| Back surface layer V (comparative example): | |
| Acrylic resin (Dianal BR-85, manufactured by Mitsubishi Rayon Co., Ltd.) | 30 parts by weight |
| Fine particles of nylon (MW-330, manufactured by Shinto Paint Co., Ltd.) | 0.08 part by weight |
| Methyl ethyl ketone | 30 parts by weight |
| Toluene | 30 parts by weight |
| Back surface layer W (comparative example): | |
| Polyester resin (Vylon 290, manufactured by Toyobo Co., Ltd.) | 30 parts by weight |
| Fine particles of nylon (MW-330, manufactured by Shinto Paint Co., Ltd.) | 0.08 part by weight |
| Methyl ethyl ketone | 35 parts by weight |
| Toluene | 35 parts by weight |
| Back surface layer X (comparative example): | |
| Polyester resin (Vylon 290, manufactured by Toyobo Co., Ltd.) | 30 parts by weight |
| Fine particles of silica (Sylysia 310, manufactured by Fuji Sylsia Chemical Ltd.) | 0.05 part by weight |
| Methyl ethyl ketone | 35 parts by weight |
| Toluene | 35 parts by weight |

<Antistatic Treatment>

| Coating solution A for antistatic treatment | |
|---|---|
| Antistatic agent (TB-34, manufactured by Matsumoto Yushi Seiyaku Co., Ltd.) | 1 part by weight |
| Isopropanol | 2000 parts by weight |

Thermal transfer image-receiving sheets were prepared using the above materials. At the outset, an antistatic layer was formed on the substrate sheet by roll coating, and an intermediate layer was then formed thereon by roll coating. The coverages of the antistatic layer and the intermediate layer were 1.0 g/m$^2$ (dry basis) and 4.0 g/m$^2$ (dry basis). Thereafter, a receptive layer was formed on the intermediate layer by roll coating at a coverage on a dry basis of 4.0 g/m$^2$.

A slip layer was formed on the back surface of the substrate by roll coating at a coverage on a dry basis of 4.0 g/m$^2$. Further, a coating solution for antistatic treatment was coated on both the surface of the receptive layer and the surface of the back surface layer by roll coating at a coverage on a dry basis of 0.01 g/m$^2$.

The coating solutions used are given in Table 3.

The thermal transfer image-receiving sheet of the present invention or the comparative thermal transfer image-receiving sheet and a commercial thermal transfer sheet were put on top of the other so as for the receptive layer to face the dye layer, and heating was carried out through the back surface of the thermal transfer sheet by means of a thermal head.

Recording was carried out under heating conditions of an applied voltage of 12 V and a pulse width of 16 msec. Under these conditions, three colors of yellow, magenta, and cyan were put on top of one another to conduct solid printing. The results are given in Table 3. Properties given in Table 3 were evaluated by the following methods.

(1) Damage to image-receiving surface

A printed image was evaluated by visual inspection and projection using OHP (over head projector.)

◎: No damage is observed by visual inspection.

○: Although slight damage is observed by visual inspection, it has no effect on projection using OHP.

(2) Curling during printing

The sheet after printing was placed on a horizontal table so that the receptive layer surface faced upward, and the distance of each of four corners of the sheet from the table was measured. The average distance was then calculated.

○: 0 mm to less than 10 mm

Δ: 10 mm to less than 30 mm

X: not less than 30 mm

TABLE 3

| | Intermediate layer | Antistatic layer | Substrate sheet | Back surface layer | Curling during printing | Damage to image-receiving surface |
|---|---|---|---|---|---|---|
| Ex. B1 | Provided | Provided | A | A | ○ | ◎ |
| Ex. B2 | Provided | Provided | A | B | ○ | ◎ |
| Ex. B3 | Provided | Provided | A | C | ○ | ◎ |
| Ex. B4 | Provided | Provided | A | D | ○ | ◎ |
| Ex. B5 | Provided | Provided | B | A | ○ | ◎ |
| Ex. B6 | Provided | Provided | B | C | ○ | ◎ |
| Ex. B7 | Not provided | Not provided | A | A | ○ | ◎ |
| Ex. B8 | Provided | Provided | A | E | ○ | ○ |
| Ex. B9 | Not provided | Not provided | A | F | ○ | ○ |
| Comp. Ex. B1 | Provided | Provided | A | V | Δ | ◎ |
| Comp. Ex. B2 | Provided | Provided | A | W | x | ◎ |
| Comp. Ex. B3 | Provided | Provided | A | X | x | ○ |
| Comp. Ex. B4 | Provided | Provided | B | X | x | ○ |

As is apparent from the results of the examples and the comparative examples, the present invention could significantly prevent curling and, hence, can significantly reduce troubles at the time of feed and delivery of the image-receiving sheet. Further, since curling by heating during printing can also be reduced, the resultant image is easy to handle.

Further, since the acrylic polyol can easily hold an additive, such as a filler, i.e., has an excellent holding property, it is possible to prevent filler from being raised during heat drying, increasing the transparency of the back surface layer. Further, it is possible to prevent a filler from coming off due to friction.

Further, the adhesion to the substrate is so good that it is possible to prevent the sheet from being powdered and coming off during sheet cutting.

Furthermore, the carriability of the sheet under any environment can be improved by providing an antistatic layer between and the receptive layer and the substrate and subjecting the outermost surface to antistatic treatment.

We claim:

1. A thermal transfer image-receiving sheet comprising:

a substrate sheet;

an antistatic layer formed on at least one surface of said substrate sheet;

an intermediate layer formed on said antistatic layer, said intermediate layer containing (i) an acrylic polyol having an OH value of from 20 to 45 or (ii) cellulose acetate butyrate having a degree of acetylation of from 0.5 to 15%, a degree of butylation of from 20 to 60%, and a hydroxyl content of from 0.5 to 5%; and a receptive layer formed on said intermediate layer.

2. The thermal transfer image-receiving sheet according to claim 1, wherein the intermediate layer has been cured.

3. The thermal transfer image-receiving sheet according to claim 2, wherein the intermediate layer has been cured with a curing agent.

4. The thermal transfer image-receiving sheet according to claim 1, wherein the antistatic layer contains a cation-modified acrylic resin.

5. The thermal transfer image-receiving sheet according to claim 1, wherein the substrate sheet has at least one surface which has been subjected to antistatic treatment and has a surface resistivity of not more than $1.0\times10^{12}\Omega/\square$ as measured under environmental conditions of a temperature of 20° C. and a humidity of 50%.

6. The thermal transfer image-receiving sheet according to claim 1, wherein a back surface layer is provided on the back surface of the substrate sheet.

7. The thermal transfer image-receiving sheet according to claim 6, wherein the resin constituting the back surface layer is an acrylic resin.

8. The thermal transfer image-receiving sheet according to claim 7, wherein the back surface layer is formed of a cured resin prepared by a reaction of an acrylic polyol with an isocyanate compound.

9. The thermal transfer image-receiving sheet according to claim 6, wherein the back surface layer contains at least one organic filler or inorganic filler.

10. The thermal transfer image-receiving sheet according to claim 1, wherein at least one of the outermost surfaces has been subjected to antistatic treatment.

11. The thermal transfer image-receiving sheet according to claim 1, which has been subjected to antistatic treatment with a quaternary ammonium salt antistatic agent.

12. The thermal transfer image-receiving sheet according to claim 1, which is a sheet for OHP.

* * * * *